US008579610B2

(12) United States Patent
Perkins, Jr. et al.

(10) Patent No.: US 8,579,610 B2
(45) Date of Patent: Nov. 12, 2013

(54) HIGH COMPRESSION DOWNHOLE PUMP

(75) Inventors: John L. Perkins, Jr., Burleson, TX (US); Michael Wayne Stowe, Fort Worth, TX (US); Benny J. Williams, Godley, TX (US)

(73) Assignee: Harbison-Fischer, Inc., Crowley, TX (US)

( * ) Notice: Subject to any disclaimer, the term of this patent is extended or adjusted under 35 U.S.C. 154(b) by 1162 days.

(21) Appl. No.: 12/060,898

(22) Filed: Apr. 2, 2008

(65) Prior Publication Data

US 2008/0247893 A1 Oct. 9, 2008

Related U.S. Application Data

(66) Substitute for application No. 60/909,743, filed on Apr. 3, 2007.

(51) Int. Cl.
*F04B 53/00* (2006.01)

(52) U.S. Cl.
USPC ..... 417/454; 417/460; 417/555.1; 417/569; 137/533.11; 137/533.17

(58) Field of Classification Search
USPC ..... 417/460, 554, 555.1, 555.2, 569, 571, 417/454; 137/533.7, 533.11, 533.13, 137/533.15; 91/422
See application file for complete search history.

(56) References Cited

U.S. PATENT DOCUMENTS 1,019,371 A 3/1912 Schneider et al.
1,603,619 A * 10/1926 McCracken ..... 137/533.13
1,796,455 A * 3/1931 Gunn et al. ..... 137/515.5
1,867,320 A 7/1932 McEvoy
1,971,270 A * 8/1934 McGregor ..... 166/105.1
1,975,184 A * 10/1934 Thomson ..... 137/533.15
2,026,058 A * 12/1935 Perry ..... 417/554
3,220,354 A * 11/1965 Sutliff ..... 417/554
4,114,694 A 9/1978 Dinning
5,120,203 A * 6/1992 Priestly ..... 417/554
5,178,184 A 1/1993 Skillman
5,183,068 A * 2/1993 Prosser ..... 137/1
5,232,014 A 8/1993 Hiltebrand
5,472,326 A * 12/1995 Tarpley ..... 417/454
5,593,289 A 1/1997 Tarpley
5,749,394 A * 5/1998 Boehmer et al. ..... 137/533.15
5,752,814 A 5/1998 Starks et al.
5,924,353 A * 7/1999 Wang ..... 92/170.1
6,029,685 A * 2/2000 Carruth ..... 137/15.19
6,257,850 B1 * 7/2001 Conn ..... 417/547
6,283,148 B1 * 9/2001 Spears et al. ..... 137/533.11
6,481,987 B2 * 11/2002 Ford ..... 417/554
6,685,451 B1 2/2004 Ivey
6,746,222 B2 6/2004 Skillman (Continued)

*Primary Examiner* — Devon Kramer
*Assistant Examiner* — Joseph Herrmann
(74) *Attorney, Agent, or Firm* — Geoffrey A. Mantooth

(57) ABSTRACT

A downhole pump has a barrel and a plunger. The barrel has a first one-way valve and the plunger has a second one-way valve. The plunger is of the box end type. The pump prevents or minimizes gas lock by achieving high compression in the compression chamber between the two valves. The second valve is located close to the bottom end of the plunger. In the second valve, the valve seat is in contact with the seat plug, which seat plug has a seal. Alternatively, the valve seat is incorporated into the seat plug, which seat plug also has a seal. The plunger lacks reliefs at the bottom end and thereby achieves tight tolerances with the barrel, further contributing to high compression.

4 Claims, 11 Drawing Sheets

(56) References Cited

U.S. PATENT DOCUMENTS 6,755,628 B1 6/2004 Howell
6,830,441 B1 * 12/2004 Williams ..... 417/555.1
2004/0013551 A1 * 1/2004 Skillman ..... 417/555.2
2005/0226752 A1 * 10/2005 Brown ..... 417/555.1
2005/0257936 A1 11/2005 Lehr

* cited by examiner

PRIOR ART

HIGH COMPRESSION DOWNHOLE PUMP

This application claims the benefit of U.S. provisional patent application Serial No. 60/909,743, filed Apr. 3, 2007.

FIELD OF THE INVENTION

The present invention relates to subsurface or downhole pumps such as are used to pump oil and other fluids in bases for oil wells.

BACKGROUND OF THE INVENTION

When an oil well is first drilled and completed, the fluids (such as crude oil) may be under natural pressure that is sufficient to produce on its own. In other words, the oil rises to the surface without any assistance.

In many oil wells, and particularly those in fields that are established and aging, natural pressure has declined to the point where the oil must be artificially lifted to the surface. Subsurface, or downhole, pumps are located down in the well below the level of the oil. A string of sucker rods extends from the pump up to the surface to a pump jack device, or beam pump unit (see FIG. 1). A prime mover, such as a gasoline or diesel engine, or an electric motor, or a gas engine on the surface causes the pump jack to rock back and forth, thereby moving the string of sucker rods up and down inside of the well tubing.

The string of sucker rods operates the subsurface pump. A typical pump (see FIG. 2) has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges a chamber between the valves with fluid and then lifts the fluid up the tubing toward the surface.

The chamber between the standing and traveling valves is referred to as the compression chamber. The standing and traveling valves open and close by differential pressure. For example, when the plunger is dropped (the downstroke), the fluid in the compression chamber is pressurized by the plunger. The fluid in the compression chamber cannot escape by way of the standing valve, because of the one-way nature of the standing valve. The only escape for the fluid in the compression chamber is through the traveling valve. However, in order to open the traveling valve, the fluid in the compression chamber must be pressurized sufficiently to overcome the pressure of the fluid above the traveling valve.

In a well that produces both liquid and gas, the pump can become gas locked. In a gas locked pump, the compression chamber contains enough gas to act as a shock absorber, resulting in insufficient differential pressure to open the traveling valve. When gas locked, the pump reciprocates without pumping any fluid.

In the prior art, pin end plungers, (which have a pin formed by exterior threads at the plunger lower end as shown in FIG. 3), or box end plungers with external valves (see FIG. 4) are used to minimize gas locking. These plungers use a valve generally attached to the bottom of the plunger. This attached valve introduces uncompressible volumes into the compression chamber, which uncompressible volumes are located around the valve, around the seat plug and internal of the seat plug. These uncompressible volumes make it more difficult to achieve a high compression ratio in order to overcome gas locking.

In another form of the prior art, a box end plunger (see FIG. 4A) is configured with an internal valve comprised of an insert, ball, seat, o-ring, spacer, and seat retainer. This arrangement is an improvement over the other prior art but still introduces unnecessary, uncompressible compression chamber volume in the spacer and the external turned-down length at each end of the plunger. These volumes also make it more difficult to achieve a high compression ratio in order to overcome gas locking.

Thus, there is a need for a high compression pump that can operate in gas locked wells.

SUMMARY OF THE INVENTION

The present invention provides a downhole pump, which comprises a barrel and a plunger. The barrel has a first one-way valve. The plunger has first and second ends, with a passage that extends between the first and second ends and a counterbore in each end. A second valve is located in one of the counterbores of the first or second ends. The second valve comprises an insert with a ball located in the insert, a seat adjacent to the insert, and a seat plug in contact with the seat. The seat plug has a channel therein with a pressure seal in the channel. The seat plug couples to the inside of the plunger so as to form a box end.

In accordance with another aspect of the present invention, the plunger has an outside diameter that is substantially the same along its length.

In accordance with still another aspect of the present invention, the plunger is reversible.

The present invention provides a downhole pump, which comprises a barrel and a plunger. The barrel has a first one-way valve. The plunger has first and second ends, with a passage that extends between the first and second ends and a counterbore in each end. A second valve is located in one of the counterbores of the first or second ends. The second valve comprises an insert with a ball located in the insert and a seat plug in contact with the seat. The seat plug has a channel therein with a pressure seal in the channel. The seat plug has a seat for the ball. The seat plug couples to the inside of the plunger so as to form a box end.

In accordance with another aspect of the present invention, the plunger has an outside diameter that is substantially the same along its length.

In accordance with still another aspect of the present invention, the plunger is reversible.

DESCRIPTION OF THE PREFERRED EMBODIMENTS

Figure 1:
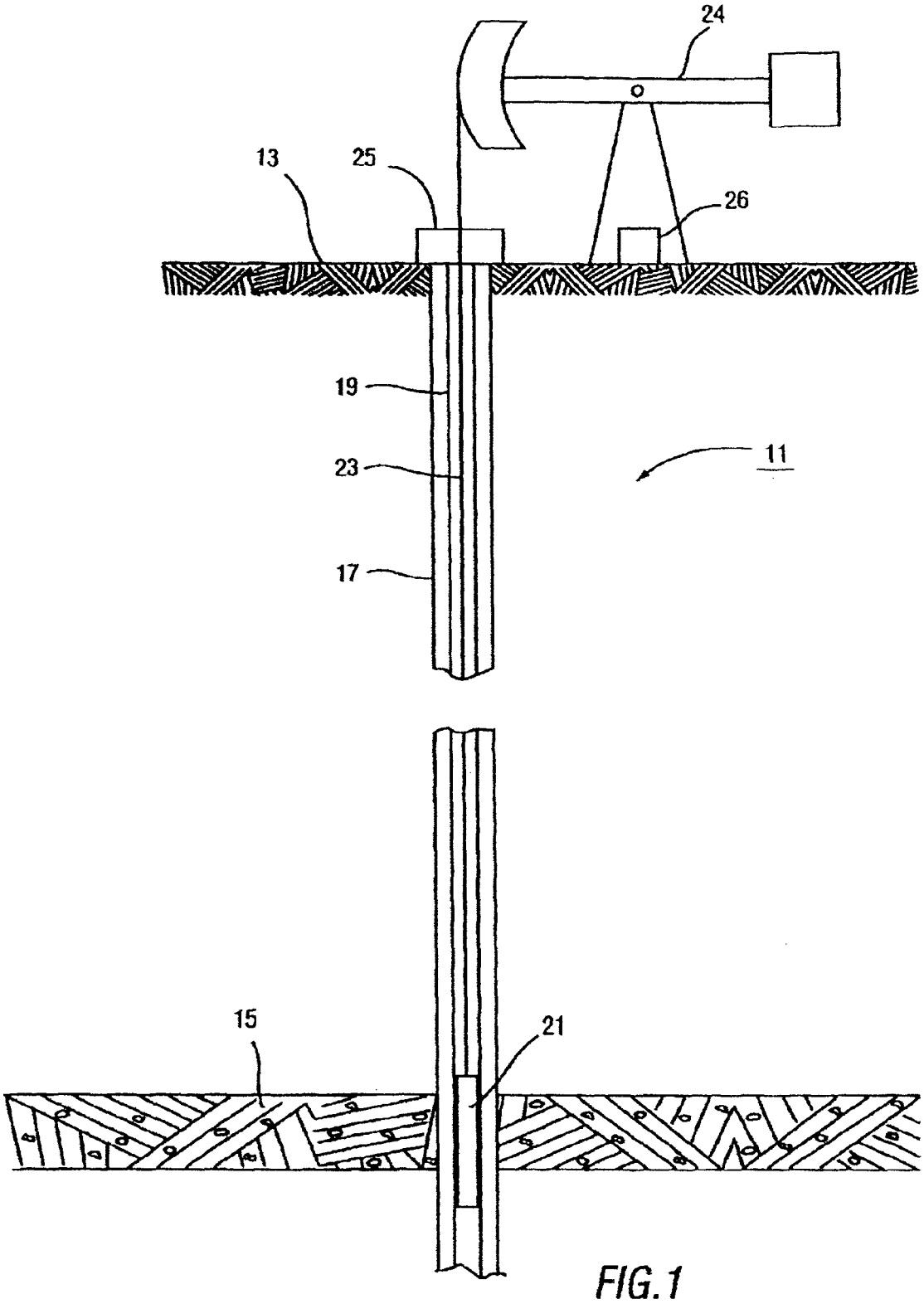
FIG. 1 is a schematic diagram of a well, shown with pumping equipment.

In FIG. 1, there is shown a schematic diagram of a producing oil well 11. The well has a borehole that extends from the surface 13 into the earth, past an oil-bearing formation 15.

The borehole has been completed and therefore has casing 17 which is perforated at the formation 15. A packer or other method (not shown) optionally isolates the formation 15 from the rest of the borehole. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod at a stuffing box 25 on the surface 13. The sucker rod string 23 is connected to a pump jack unit 24 which reciprocates up and down due to a prime mover 26, such as an electric motor, a gasoline or diesel engine, or a gas engine.

Figure 2:
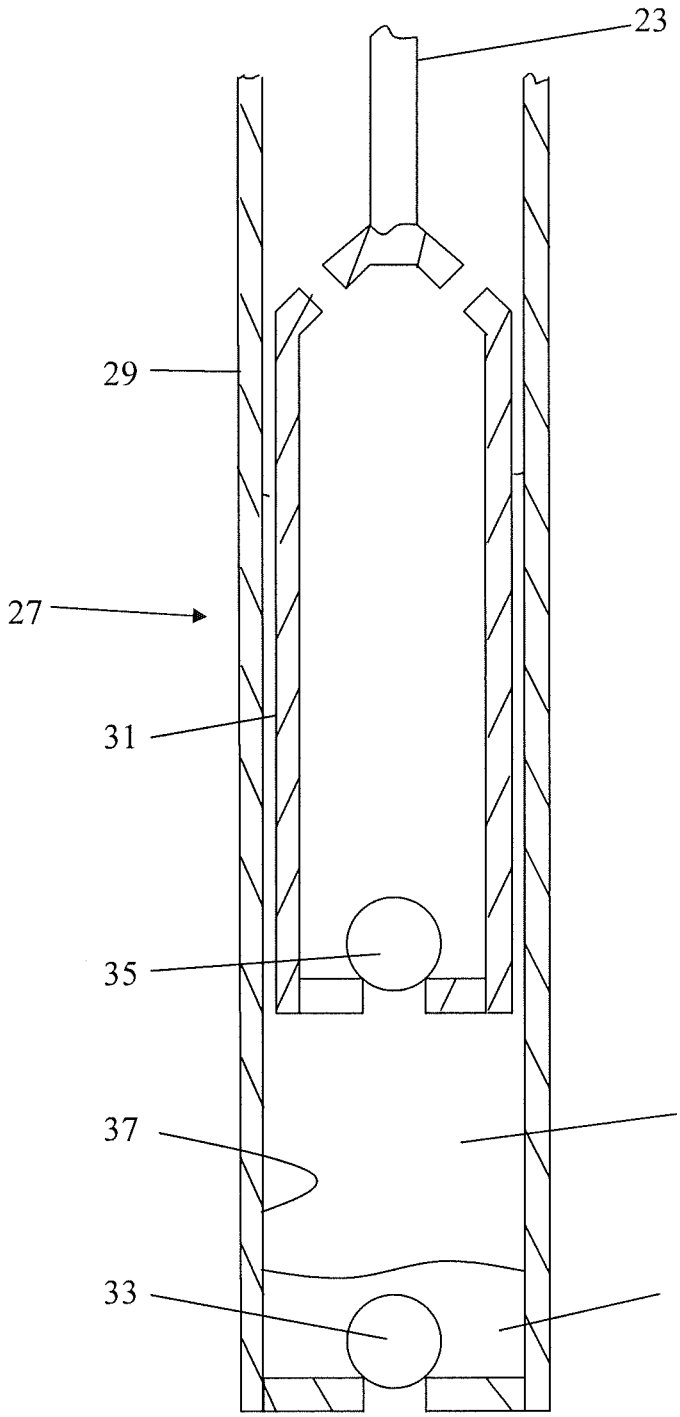
PRIOR ART FIG. 2
FIG. 2 is a longitudinal partial cross-sectional view of a downhole pump.

FIG. 2 illustrates a typical downhole pump 27. In FIG. 2, valve inserts or cages and other details are not shown. The pump 27 has a barrel 29 and a plunger 31 which reciprocates inside of the barrel. The barrel 29 has a standing valve 33 and the plunger has a traveling valve 35.

The plunger is reciprocated inside of the barrel by the sucker rods 23. As the plunger 31 is raised on the upstroke, fluid is drawn into a compression chamber 37 located between the two valves 33, 35. The fluid contains liquid 39, such as oil and condensate, and gas 41, such as natural gas, air or vacuum. The gas 41 may be separated from the liquid 39 as shown in the drawing, or it may be in solution with the liquid.

Figure 3:
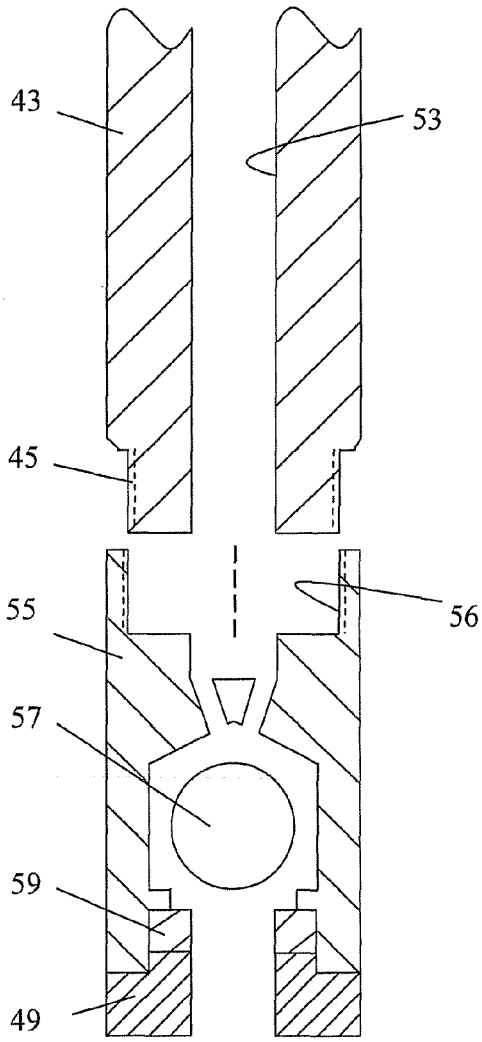
Fig. 3 PRIOR ART
FIG. 3 is an exploded view of the lower end of a prior art pin end plunger and valve.

In the prior art, plungers have pin ends or box ends. In a pin end plunger 43 (see FIG. 3), the lower end of the plunger has external threads 45. The lower end of the plunger has a bore 53 which extends the length of the plunger 43. An external valve is attached to the lower end of the plunger. The valve has a cage 55, a ball 57, a seat 59 and a seat plug 49. The cage 55 has internal threads 56 that are threaded onto the lower end threads 45 of the plunger 43. The seat plug 49 retains the ball 57 and the seat 59 inside of the cage 55. The seat plug 49 forms a metal-to-metal seal with the cage 55.

In a box end plunger 61 (see FIGS. 4 and 4A), the lower end of the plunger has internal threads for receiving the external threads of the valve components. FIG. 4 shows a box end plunger 61 having external valve components. The valve is similar to that shown in FIG. 3, having a cage 55A, a ball 57, a seat 59 and a seat plug 49. The upper end of the cage 55A has exterior threads 67 to engage the interior threads 63 of the plunger 61. A passage 71 extends between the two ends of the plunger 61. The passage 71 is larger than the passage 53 of the pin end plunger 43. In addition, the lower end of the plunger 61 has reliefs 83 machined therein to decrease the outside diameter of the plunger at the lower end. The reliefs 83 compensate for wall movement; when the cage 55A is screwed into the passage 71, the wall of the plunger lower end bulges out. The reliefs 83 are 1/32" deep as measured on the diameter. The reliefs 83 extend over an inch from the ends of the plunger. The plunger 61 is reversible with both ends having reliefs 83 and capable of functioning as either a top end or a bottom end.

The plungers 43 and 61 (shown in FIGS. 3 and 4, respectively) have an uncompressible space or volume around the outside diameter of the cage 55, 55A. Due to the difficulty and expense of manufacturing concentric threads 56, 67 with the diameter of the cages and of manufacturing concentric threads 45, 63 with the diameter of the plunger, the cages are made with a slightly reduced outside diameter. This avoids wear of the cage on the barrel. The cages have a reduced outside diameter, relative to the plunger outside diameter, of about 1/32 to 1/16 inches. This gap between the cage and the barrel creates a space or volume that cannot be compressed. Other uncompressible volumes are around the seat plug 49 and internal of the seat plug.

Figure 4A:
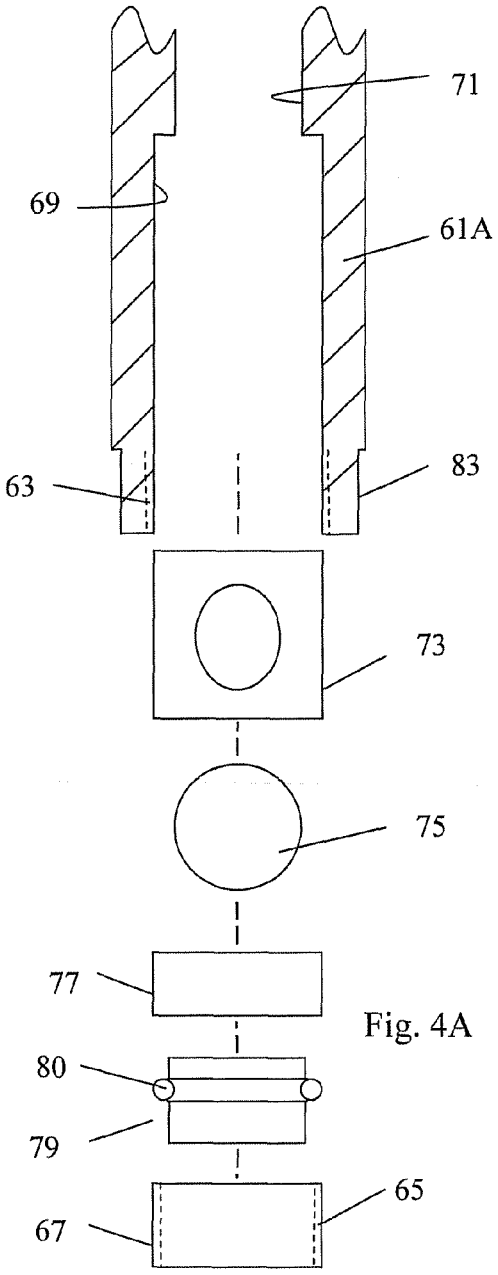
FIG. 4A is an exploded view of the lower end of a prior art box end plunger and internal valve.
Figure 4:
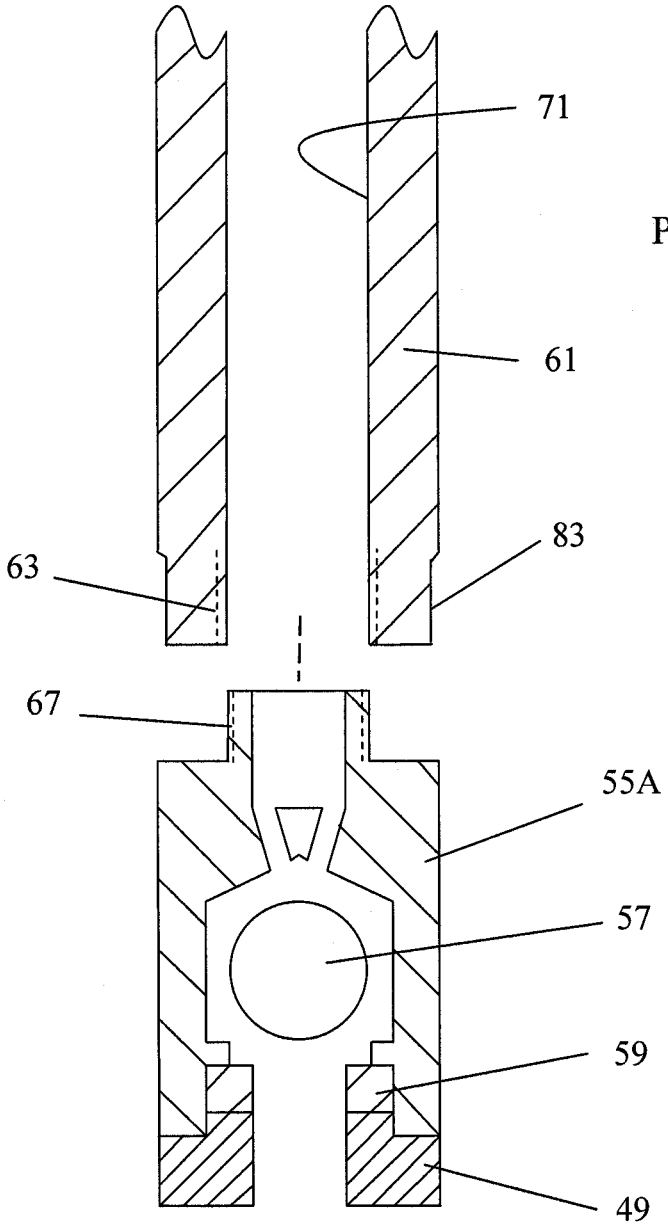
FIG. 4 is an exploded view of the lower end of a prior art box end plunger and external valve.

Still another prior art box end plunger 61A is shown in FIG. 4A. The plunger 61A has internal traveling valve components. The lower end of the plunger has a counterbore 69 which communicates with a passage 71. The passage 71 of the box end plunger is larger than the passage 53 of the pin end plunger. The counterbore 69 receives the valve insert 73, the valve ball 75, the valve seat 77 and a spacer 79 with an o-ring seal 80. This plunger 61A has uncompressible volumes in the spacer 79, in the external turn-downs, or reliefs 83, at the ends, and internal of the seat plug 65.

Figure 7:
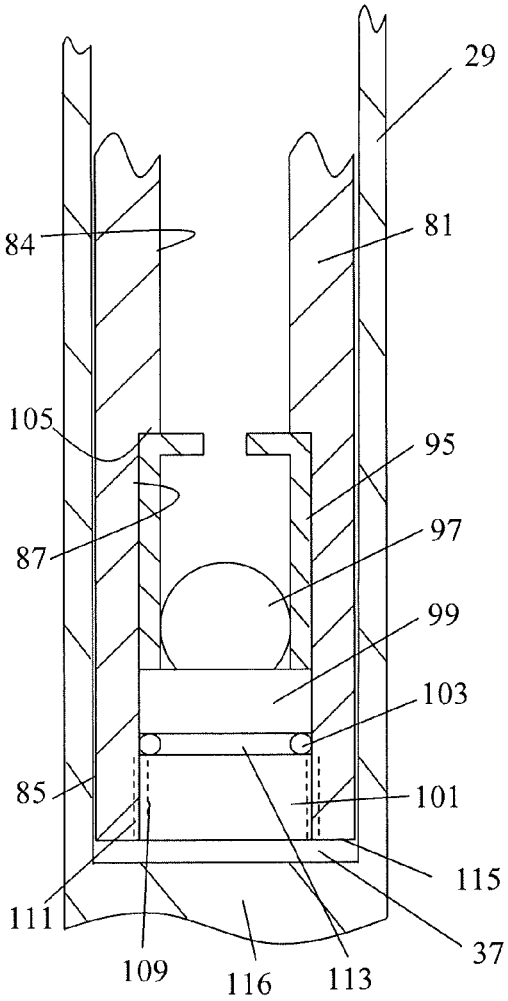
FIG. 7 is a cross-sectional view of the lower end portion of the plunger of the present invention.

The present invention provides a pump with a box end plunger that makes the compression chamber small at the bottom of the downstroke (when the compression chamber is at its smallest volume), thereby achieving high compression in the compression chamber 37 (see FIG. 7). The high compression in turn causes the traveling valve to open even with large amounts of gas, thereby preventing or minimizing gas lock. The plunger is also suitable for use with heavy crude or in high flow wells.

Figure 5:
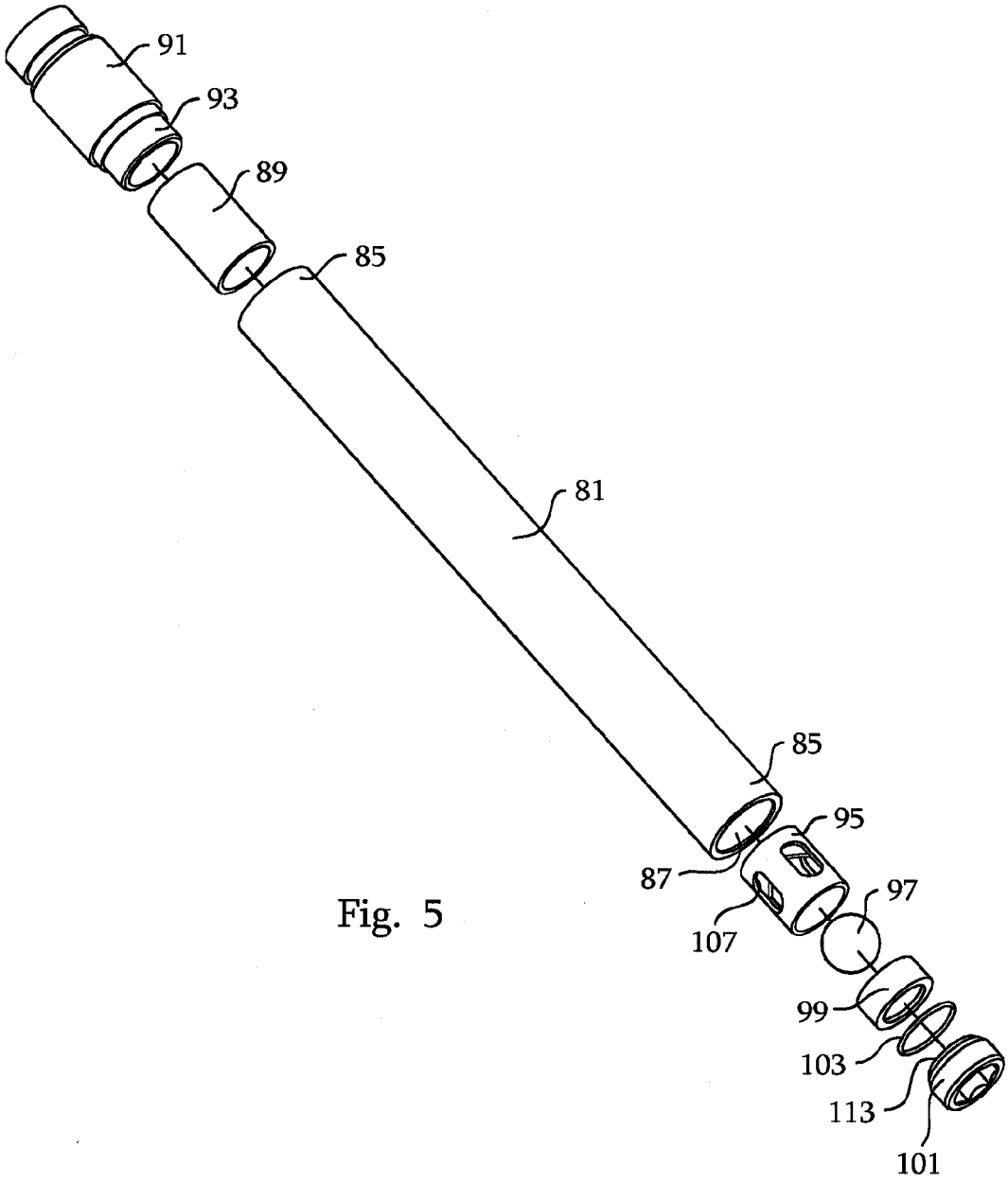
FIG. 5 is a perspective exploded view of the plunger of the present invention, in accordance with a preferred embodiment.
Figure 6:
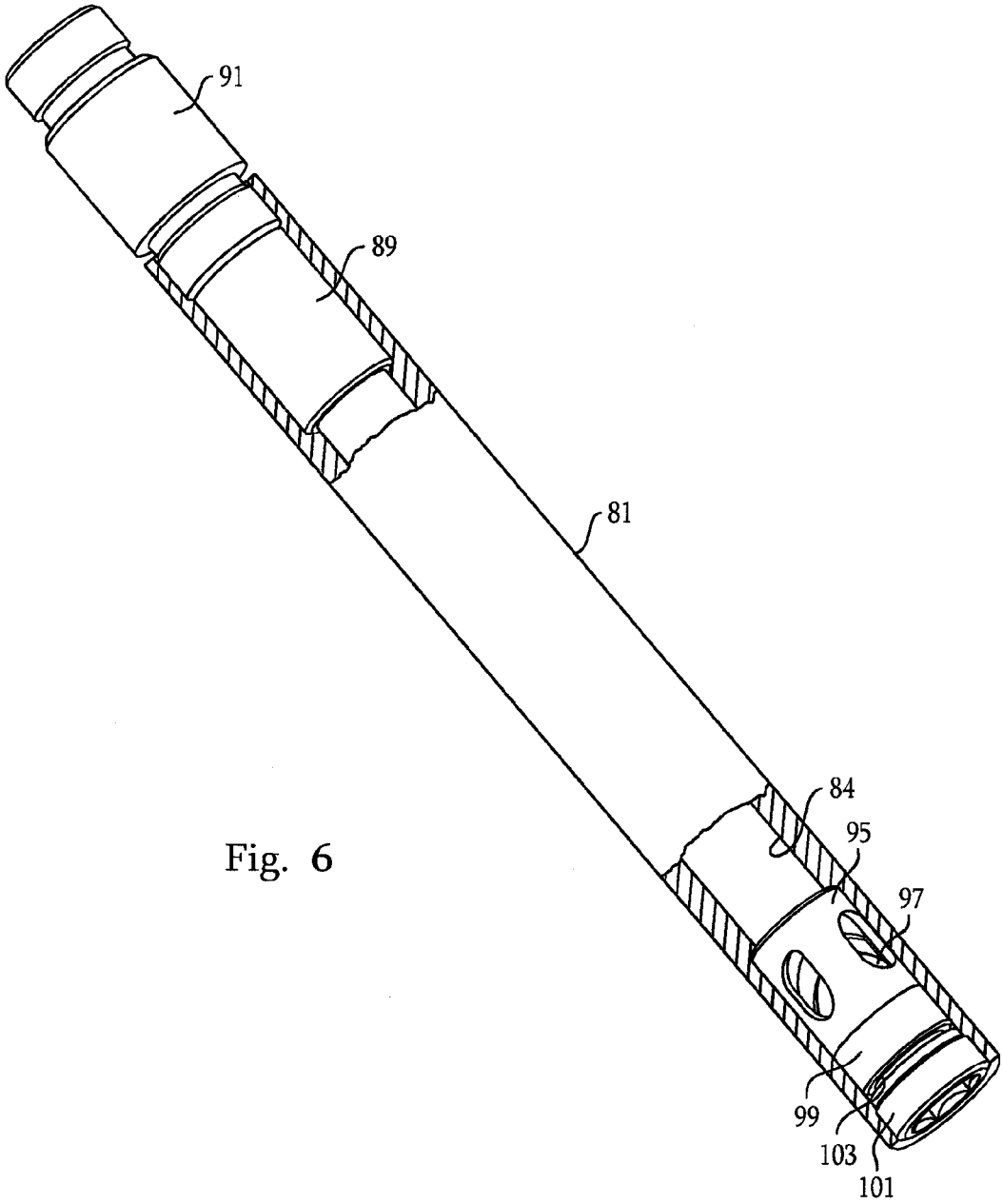
FIG. 6 is a perspective view of the assembled plunger of FIG. 5.
Figure 6A:
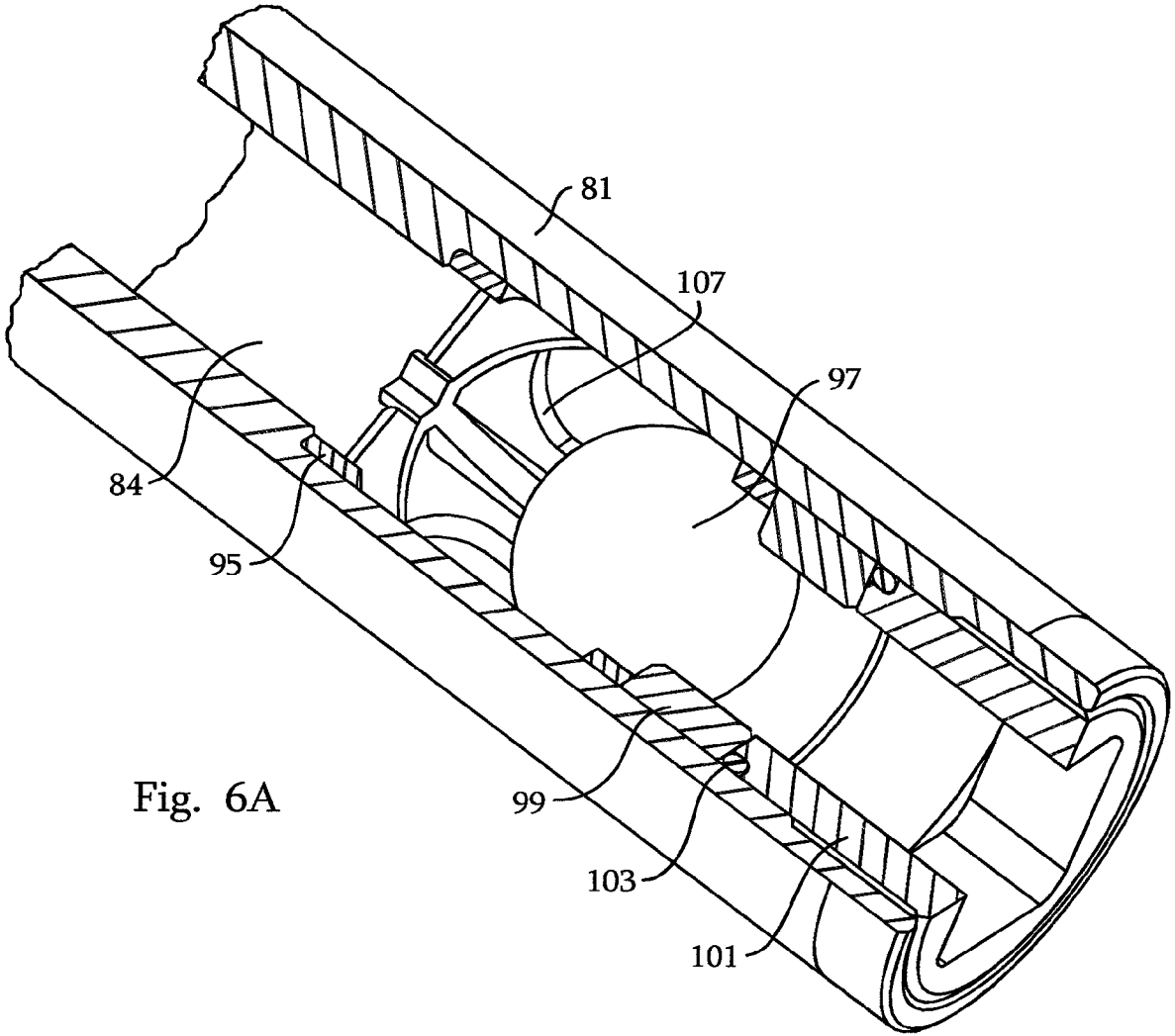
FIG. 6A is a perspective view of the lower end of the assembled plunger of FIG. 5, shown cut away.

The plunger 81 of the present invention is illustrated in FIGS. 5, 6 and 6A. The plunger 81 is a hollow tube, having a passage 84 therethrough. The plunger has two ends 85; each end has a counterbore 87 formed therein. At one end, the top end, retainer components are inserted. At the other end, the bottom end, traveling valve components are inserted. Each end of the plunger has a reduction in outside diameter of about 0.005 inches, extending 3/8 inch from the end, to account for slight swelling of the diameter on the plunger end when the valve components are inserted and tightened into the plunger. This reduction in diameter is so small as to be substantially the same as the diameter along the remainder of the plunger, and after the valve components are inserted, the diameters are even more so substantially the same.

The retainer components are a spacer 89 and a retainer 91. The spacer 89 is a hollow tube, typically unthreaded. The retainer 91 is also a hollow tube, with external threads 93 on at least one end, which end is threaded into one of the plunger counterbores 87. The retainer couples to the sucker rod string 23. The retainer 91 and the spacer 89 can be a single component as shown, or can be two separate components.

The traveling valve components are a valve insert 95, a valve ball 97, a valve seat 99 and a seat plug 101. The insert 95 is inserted into the counterbore 87 at one end of the plunger. The insert abuts a shoulder 105 (see FIG. 7). The insert 95 has openings 107 (see FIG. 5) in the sides to allow fluid to flow past the ball 97 when the valve is open. The ball 97 is put into the insert 95. The seat 99 then follows so as to abut the bottom end of the insert. The seat plug 101 is inserted into the counterbore 87. The seat plug 101 contains an o-ring seal 103 that seals against pressure. Other types of pressure seals can be used, such as o-rings with backup seals, cup type seals and x-type seals.

The seat plug 101 has exterior threads 109 (see FIG. 7) to engage interior threads 111 in the counterbore 87. The interior threads 111 of the counterbore extend from the open end of the counterbore toward the shoulder 105 for a distance that is substantially the same as the threaded length of the seat plug 101. The seal 103 contacts an unthreaded, or smooth, surface of the counterbore 87. The seat plug 101, which is a hollow ring, typically has a hexagonal or square shape for the lower part of its interior bore so as to receive a tool that installs and removes the plug from the plunger end. The seat plug 101 has around its inner end a circumferential channel 113. The channel 113 receives the o-ring 103. When the seat plug 101 is installed into an end of the plunger, the seat plug contacts the seat 99 and the o-ring 103 is compressed between the seat plug and the valve seat 99 and forms a seal. Additionally a seal is accomplished in counterbore 87.

Although the channel 113 has been described as between two parts (namely the seat plug 101 and the seat 99), the channel can be within a single part. For example, the channel can be entirely on the seat plug, wherein the channel takes on the form of a groove.

Figure 8:
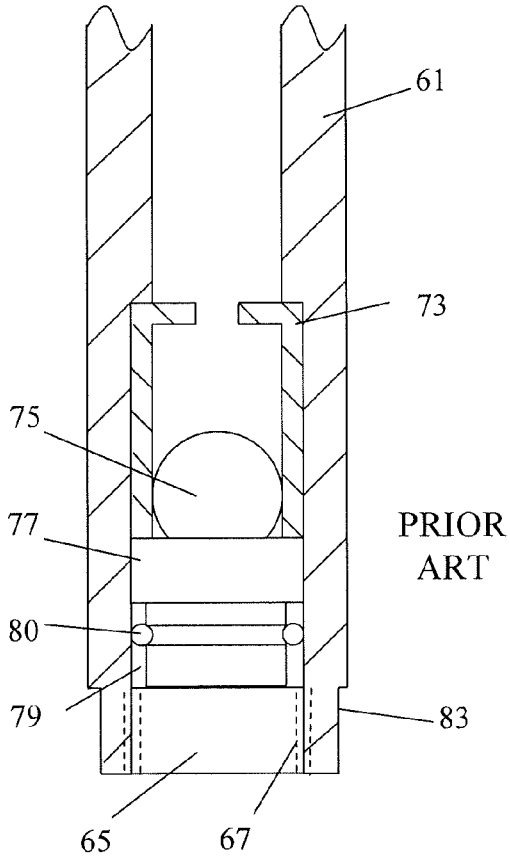
FIG. 8 is a cross-sectional view of the lower end of the prior art plunger of FIG. 4A.

With the plunger of the present invention, the traveling valve 97, 99 is located close to the bottom end 1 15 of the plunger. Comparing the plunger 81 of the present invention (FIG. 7) with the prior art box end, internal valve plunger 61 (FIG. 8), the difference in spacing of the valve seats 99, 77 from the bottom of the plunger is noticeable. The box end plunger 81 of the present invention is able to achieve high compression because of the reduced spacing between the traveling valve components and the standing valve components 1 16.

In addition, the plunger of the present invention has minimal or no relief at the bottom end 115. This makes the clearance between the plunger end and the barrel smaller and tighter than the plunger 61A of FIG. 4A. In addition, the clearance between the plunger end and the barrel is smaller and tighter than the plungers 43 and 61 of FIGS. 3 and 4 which have gaps (due to manufacturing tolerances) between the cages and the barrel. As a result, the plunger 81 can achieve higher compressions. With a standard conventional plunger, a compression ratio of about 34:1 can be achieved. With the plunger of the present invention, a compression rate of about 45:1 can be achieved, an increase of 33% in compression ratio. If the plunger is used in conjunction with a high compression standing valve, the compression ratio is higher still.

Furtherstill, the two ends of the plunger 81 are reversible. Each end can function as either the top end or the bottom end. When the plunger is installed into a downhole pump, the top end will wear faster than the bottom end. The plunger can be pulled from the well and the plunger reversed and reinstalled. What was the bottom end, with little or no wear, is now the top end. The amount of wear relative to the reliefs 83 is small by an order of magnitude or so. Thus, a worn top end can be used as a bottom end and still achieve high compression due to tight tolerances with the barrel.

Figure 9:
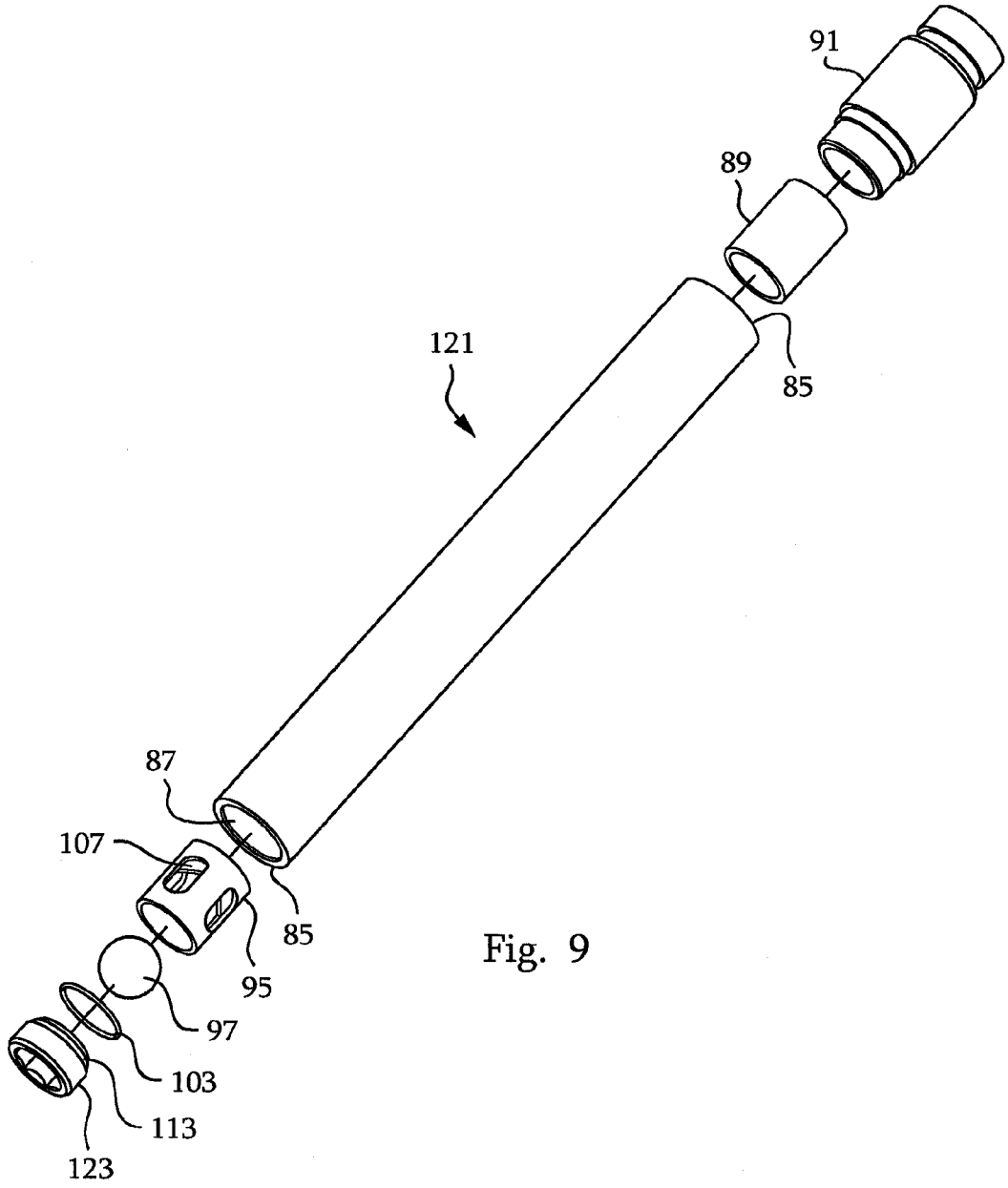
FIG. 9 is a perspective exploded view of the plunger of the present invention, in accordance with another embodiment.
Figure 10:
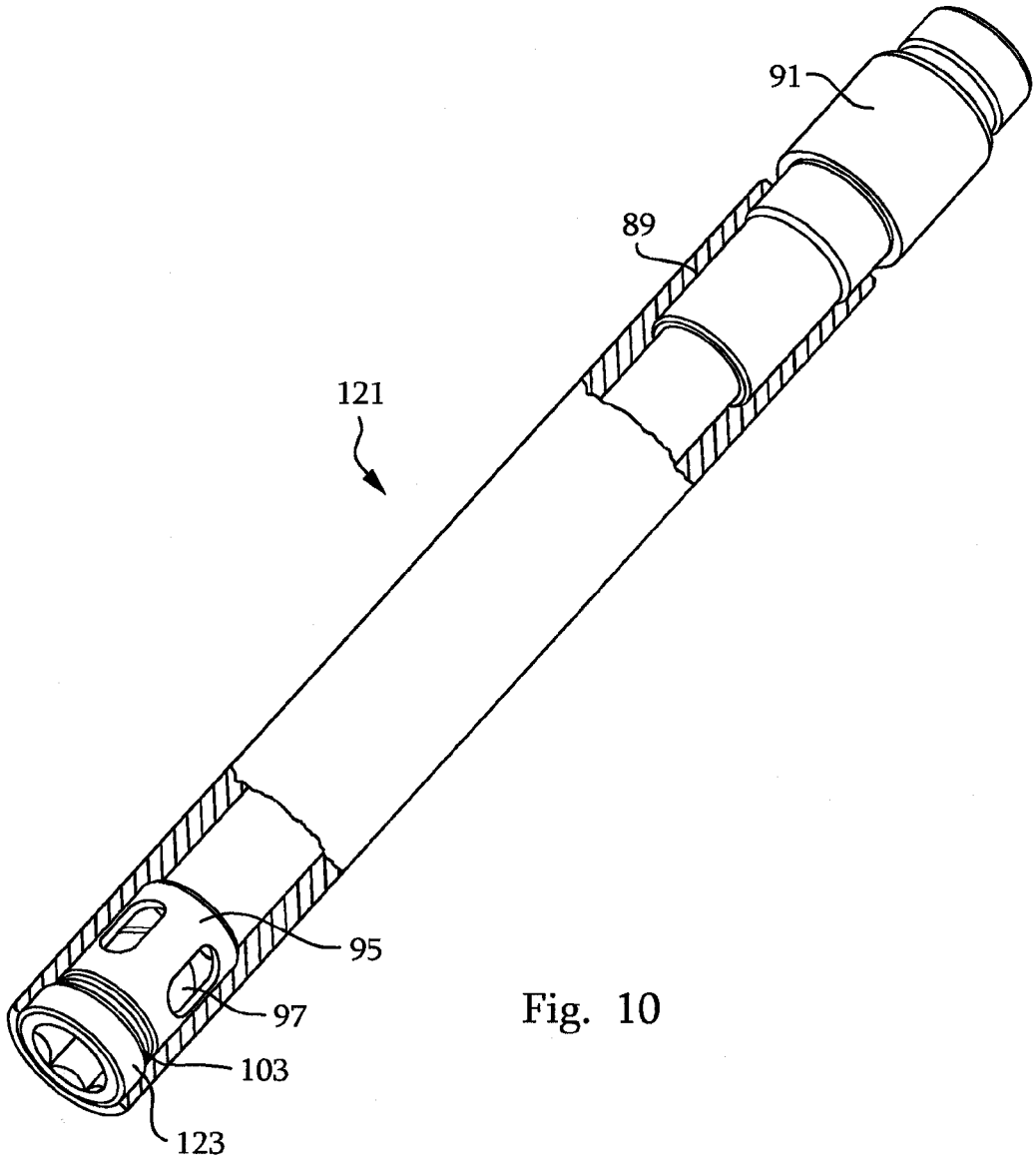
FIG. 10 is a perspective view of the assembled plunger of FIG. 9.
Figure 11:
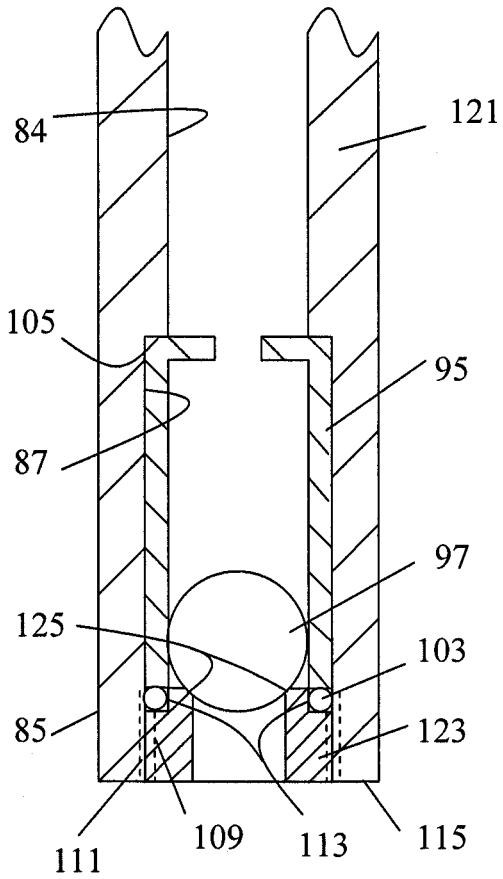
FIG. 11 is a cross-sectional view of the lower end portion of the plunger of FIGS. 9 and 10.

FIGS. 9-11 show the plunger 121 in accordance with another embodiment. In this embodiment, the seat plug functions as both a seat for the valve ball and also as a holder for the seal. In the description that follows, like reference numbers designate like parts or components in the various embodiments.

The box end plunger 121 is similar to the plunger 81 described with respect to FIGS. 5-7. The plunger 121 has a passage 83 therethrough and two ends 85, with each end having a counterbore 87 formed therein. The plunger 121 is reversible. At one end, the top end, retainer components, in the form of a spacer 89 and a retainer 91, are inserted. At the other end, the bottom end, traveling valve components are inserted.

The traveling valve components are a valve insert 95, a valve ball 97 and a seat plug 123. The insert 95 abuts a shoulder 105 in the counterbore 87.

The seat plug 123 has a seat 125 for the valve ball 97. The seat plug 123 also has a circumferential channel 113 around the inner end. The channel 113 receives the seal 103.

The seat plug 123 is a hollow ring, with a square or hex shape for its inner bore. The seat plug has exterior threads 109 that engage interior threads 111 of the counterbore 87.

Assembly involves inserting the insert 95 into the counterbore 87, then the ball 97 and then the seat plug 123. The seat plug has the seal 103 in the channel 113. When the seat plug 123 is installed and tightened into the plunger, the seat plug contacts the insert 95. The seal 103 is compressed between the insert 95 and the seat plug 123 and forms a seal. When the valve is closed, the ball 97 is in the seat 125, as shown in FIG. 11. When the valve is open, the ball is off of the seat.

Locating the valve seat 125 and the seal 103 on the seat plug 123 serves to further reduce the volume of the compression chamber when the plunger is at the bottom of the downstroke, thereby achieving high compression. The plunger 121 has minimal or no relief at the bottom end to further minimize the volume of the compression chamber.

Thus, the present invention provides a box end plunger that achieves high compression. Consequently, gas lock of the pump is minimized or even eliminated. The plunger is reversible to increase wear and useful life, making the plunger more cost effective to use.

The plunger of the present invention can be used in tubing pumps or insert pumps. The plunger can reciprocate or the barrel can reciprocate.

The foregoing disclosure and the showings made in the drawings are merely illustrative of the principles of this invention and are not to be interpreted in a limiting sense.

The invention claimed is:

1. A downhole pump, comprising:

a) a barrel having a first one-way valve;

b) a plunger having first and second ends, with a passage that extends between the first and second ends and a counterbore in each of the first and second ends, the plunger second end located between the plunger first end and the first valve, each of the counterbores having a threaded portion and an unthreaded portion, with the respective threaded portion extending from the respective first and second end and located between the respective first and second end and the respective unthreaded portion, each of the first and second ends of the plunger being blunt and non-tapered the plunger reciprocating in the barrel between an upstroke and a downstroke;

c) a second one-way valve located in the counterbore of the second end, the second valve comprising an insert with a ball located in the insert, a seat adjacent to the insert, and a seat plug having a seat end and an exterior end, the seat end of the seat plug being in contact with the seat, the seat plug having a channel therein with a pressure seal in the channel, the seat plug removably coupled to the threaded portion of the second end counterbore so as to form a box end of the plunger, the insert, the seat and the seat plug located inside of the plunger passage with the insert located in the unthreaded portion of the second end counterbore, the exterior end of the seat plug being substantially coplanar with the second end of the plunger so as to permit the seat to be located close to the first one-way valve of the barrel when the plunger is at a bottom of the downstroke, the seat plug removable from the plunger through the second end of the plunger;

d) the plunger being reversible so that the second one-way valve can be located in the first end counterbore of the plunger when the plunger first end is located between the plunger second end and the first one-way valve.

2. The pump of claim 1 wherein the plunger has an outside diameter that is substantially the same along the length of the plunger.

3. A downhole pump, comprising:

a) a barrel having a first one-way valve;

b) a plunger having first and second ends, with a passage that extends between the first and second ends and a counterbore in each of the first and second ends, the plunger second end located between the plunger first end and the first valve, each of the counterbores having a threaded portion and an unthreaded portion, with the respective threaded portion extending from the respective first and second end and located between the respective first and second end and the respective unthreaded portion, each of the first and second ends of the plunger being blunt and non-tapered the plunger reciprocating in the barrel between an upstroke and a downstroke;

c) a second one-way valve located in the counterbore of the second end, the second valve comprising an insert with a ball located in the insert, a seat plug in contact with the insert, the seat plug having a channel therein with a pressure seal in the channel, the seat plug having a seat for the ball, the seat plug removably coupled to the threaded portion of the second end counterbore so as to form a box end, the insert and the seat plug located inside of the plunger passage with the insert located in the unthreaded portion of the second end counterbore, the seat plug having an exterior end that is substantially coplanar with the second end of the plunger so as to permit the seat to be located close to the first one-way valve of the barrel when the plunger is at a bottom of the downstroke, the seat plug removable from the plunger through the second end of the plunger;

d) the plunger being reversible so that the second one-way valve can be located in the first end counterbore of the plunger when the plunger first end is located between the plunger second end and the first one-way valve.

4. The pump of claim 3 wherein the plunger has an outside diameter that is substantially the same along the length of the plunger.

* * * * *